US010435878B2

(12) United States Patent
Saeki et al.

(10) Patent No.: US 10,435,878 B2
(45) Date of Patent: Oct. 8, 2019

(54) FLUSH TOILET

(71) Applicant: LIXIL Corporation, Tokyo (JP)

(72) Inventors: Akiya Saeki, Tokyo (JP); Hiroaki Watanabe, Tokyo (JP); Tomoya Sasaki, Tokyo (JP); Ryuichi Yokoi, Tokyo (JP)

(73) Assignee: LIXIL Corporation, Tokyo (JP)

( * ) Notice: Subject to any disclaimer, the term of this patent is extended or adjusted under 35 U.S.C. 154(b) by 0 days.

(21) Appl. No.: 15/756,498

(22) PCT Filed: Jun. 24, 2016

(86) PCT No.: PCT/JP2016/068818

§ 371 (c)(1),
(2) Date: Feb. 28, 2018

(87) PCT Pub. No.: WO2017/038222

PCT Pub. Date: Mar. 9, 2017

(65) Prior Publication Data

US 2018/0258628 A1 Sep. 13, 2018

(30) Foreign Application Priority Data

Aug. 31, 2015 (JP) ..... 2015-171093

(51) Int. Cl.
*E03D 11/13* (2006.01)
*E03D 9/08* (2006.01)

(52) U.S. Cl.
CPC ..... *E03D 11/13* (2013.01); *E03D 9/08* (2013.01)

(58) Field of Classification Search
CPC ..... E03D 11/13
USPC ..... 4/300
See application file for complete search history.

(56) References Cited

FOREIGN PATENT DOCUMENTS

| | | |
|---|---|---|
| CN | 104514257 | 4/2015 |
| JP | 60-53872 | 4/1985 |
| JP | 3-46584 | 4/1991 |
| JP | 5-81377 | 11/1993 |
| JP | 2001-231715 | 8/2001 |
| JP | 2009-41200 | 2/2009 |
| JP | 2010-24780 | 2/2010 |
| JP | 2010-196375 | 9/2010 |
| JP | 2014-218864 | 11/2014 |

OTHER PUBLICATIONS

International Search Report dated Aug. 2, 2016, directed to International Application No. PCT/JP2016/068818; 4 pages.
International Preliminary Report on Patentability dated Mar. 6, 2018 directed to International Application No. PCT/JP2016/068818; 12 pages.
Decision to Grant Patent dated Dec. 18, 2018, directed to Japanese Application No. 2015-171093; 6 pages.

*Primary Examiner* — Lori L Baker
(74) *Attorney, Agent, or Firm* — Morrison & Foerster LLP

(57) ABSTRACT

A flush toilet is provided with a toilet main unit and a functional unit. The toilet main unit has a toilet bowl and an upper surface portion on which a recessed portion is formed. The functional unit is provided on the rear side of the toilet bowl and offers a function different from a function for washing the toilet bowl. The functional unit is able to move between an entering position where at least a portion of the functional unit is located inside the recessed portion and a retreating position where the entire functional unit is located outside the recessed portion.

15 Claims, 10 Drawing Sheets

FLUSH TOILET

SUMMARY OF THE INVENTION

The above-described flush toilet has a disadvantage in that, although the height thereof can be relatively reduced, it is difficult to clean the recessed portion.

In this background, a purpose of the present invention is to provide a flush toilet that is easy to be cleaned while having a relatively reduced height.

To solve the problem above, a flush toilet according to one embodiment of the present invention is provided with: a toilet main unit having a toilet bowl and an upper surface portion on which a recessed portion is formed; and a functional unit that is provided on the rear side of the toilet bowl and offers a function different from a function for washing the toilet bowl. The functional unit is able to move between an entering position where at least a portion of the functional unit is located inside the recessed portion and a retreating position where the entire functional unit is located outside the recessed portion.

Optional combinations of the aforementioned constituting elements, and implementations of the invention in the form of methods, systems, etc., may also be practiced as additional modes of the present invention.

BRIEF DESCRIPTION OF THE DRAWINGS

Embodiments will now be described byway of examples only, with reference to the accompanying drawings which are meant to be exemplary, not limiting and wherein like elements are numbered alike in several Figures in which.

DETAILED DESCRIPTION OF THE INVENTION

Figure 1A:
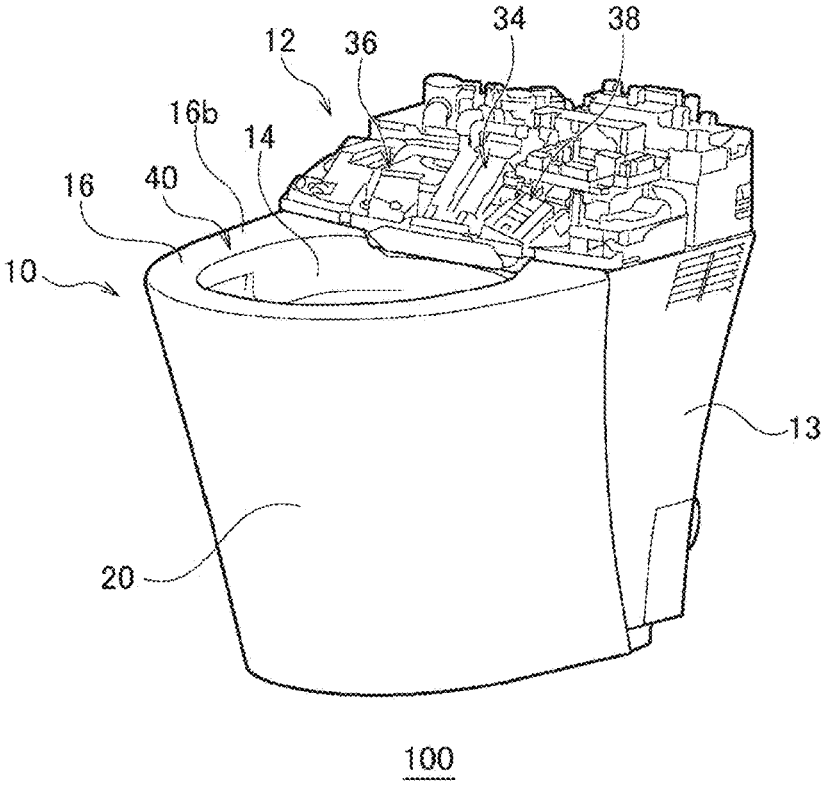
FIGS. 1A and 1B are perspective views of a flush toilet according to a first embodiment.

The same or equivalent constituting elements and members illustrated in each drawing shall be denoted by the same reference numerals, and duplicative explanations will be omitted appropriately. The dimension of members in the drawings shall be enlarged or reduced as appropriate to facilitate understanding. Some of the members not important for describing the embodiments are omitted from each drawing.

Figure 1B:
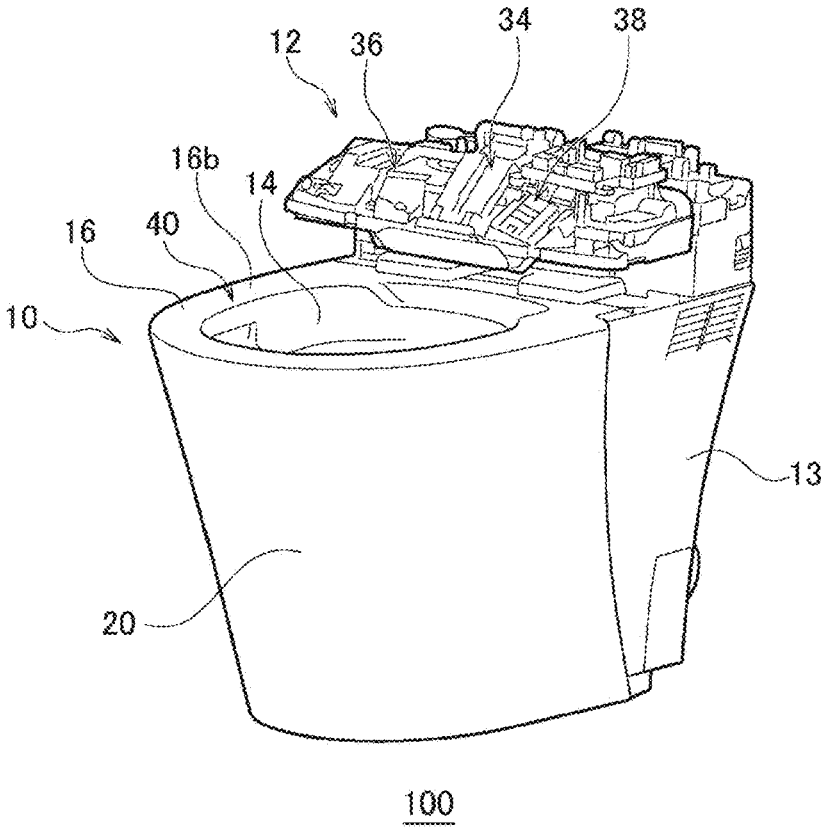
Figure 2:
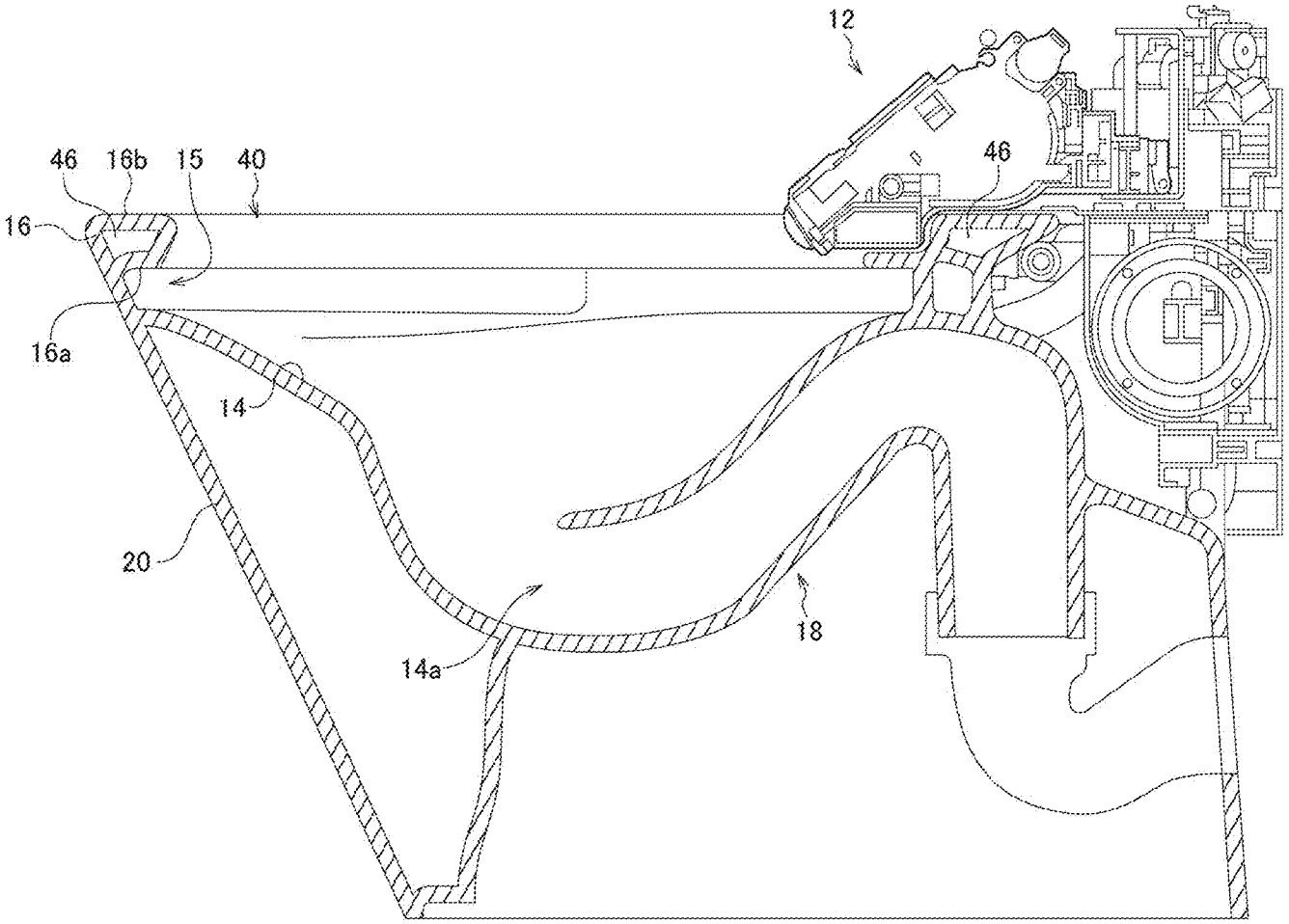
FIG. 2 is a cross sectional view of a flush toilet according to the first embodiment.

FIGS. 1A and 1B are perspective views of a flush toilet 100 according to a first embodiment. FIG. 1A shows a state where a functional unit 12 and a cover 13 are not uplifted, and FIG. 1B shows a state where the functional unit 12 and the cover 13 are uplifted. FIG. 2 is a cross sectional view of the flush toilet 100. FIG. 2 shows a state where the functional unit 12 is not uplifted. FIGS. 1A and 1B and FIG. 2 show a state where a toilet seat, a toilet seat cover, a cover that covers the functional unit 12, and the like are removed. In FIG. 2, the display of the cover 13 is omitted.

The flush toilet 100 is a Western style flush toilet and is provided with a toilet main unit 10, a functional unit 12, and a cover 13. In the following, front, back, left, and right directions are those directions viewed from a user sitting on the flush toilet 100 in a regular posture.

The toilet main unit 10 is formed of a ceramic material. The toilet main unit 10 may be formed of a resin material or other materials. The toilet main unit 10 includes a toilet bowl 14, an upper surface portion 16, a toilet drainage channel 18, and an outer circumferential wall portion 20. The toilet bowl 14 is an approximately funnel-shaped member and receives waste. The inner circumferential edge of an upper portion of the toilet bowl 14 forms a lower surface 16*a* of the upper surface portion 16 and also a water passage 15 for creating a swirling flow.

One end of the toilet drainage channel 18 leads to an outlet port 14*a* of the toilet bowl 14, and the other end of the toilet drainage channel 18 leads to a drainpipe (not shown). When washing water is supplied to the toilet bowl 14, waste flows inside the toilet drainage channel 18 along with the washing water and is discharged from the toilet drainage channel 18 to the drainpipe. The outer circumferential wall portion 20 surrounds the outer circumference side of the toilet bowl 14 and the toilet drainage channel 18 in a concealing manner.

The upper surface portion 16 is connected to the upper end peripheral edge of the toilet bowl 14. The upper surface portion 16 has an opening portion 40 having an approximately elliptic shape that is slightly smaller than the shape of the upper end peripheral edge of the toilet bowl 14. An upper surface 16*b* of the upper surface portion 16 located at an upper part of the toilet bowl 14 is formed flat, and this opening portion 40 functions as a contact surface with which a toilet seat (not shown) comes into contact when the toilet seat is closed. The upper surface 16*b* of the upper surface portion 16 functions as a placement surface on which the functional unit 12 is placed. Further, the upper surface portion 16 includes a hollow portion 46 inside the upper surface portion 16.

The functional unit 12 is provided on an upper portion of the toilet bowl 14 on the rear side while a portion of the functional unit 12 is placed on the upper surface portion 16. The functional unit 12 is an electrical component that is used while being attached to the toilet main unit 10 and is a set of a plurality of devices that each offer a function that is different from a function for washing the toilet bowl 14. In the present embodiment, the functional unit 12 includes a private part washing device 34 for washing a private part, a drying device 36 for drying one's buttocks, and a deodorizing device 38 for deodorizing odors produced in the toilet bowl 14. The drying device 36, the private part washing device 34, and the deodorizing device 38 are lined up in this order in the lateral direction from the right side.

The cover 13 is installed on the rear side of the toilet main unit 10. The cover 13 covers the rear side of the toilet main unit 10 and ensures the design of the flush toilet 100.

The functional unit 12 and the cover 13 are uplifted by a lifting and lowering mechanism (not shown). More specifically, the functional unit 12 and the cover 13 move up and down between a lowered position (the position shown in FIG. 1A) where at least a portion of the functional unit 12 is placed on the upper surface portion 16 and a raised position (the position shown in FIG. 1B) where the functional unit 12 is not placed on the upper surface portion 16. By raising the functional unit 12 to the raised position, a space for hand insertion can be created between the functional unit 12 and the upper surface portion 16. A user can insert his/her hand through this space to wipe the rear side of the upper surface portion 16. The functional unit 12 and the cover 13 may be moved up and down by being lifted up by a user with his/her hands.

Figure 3:
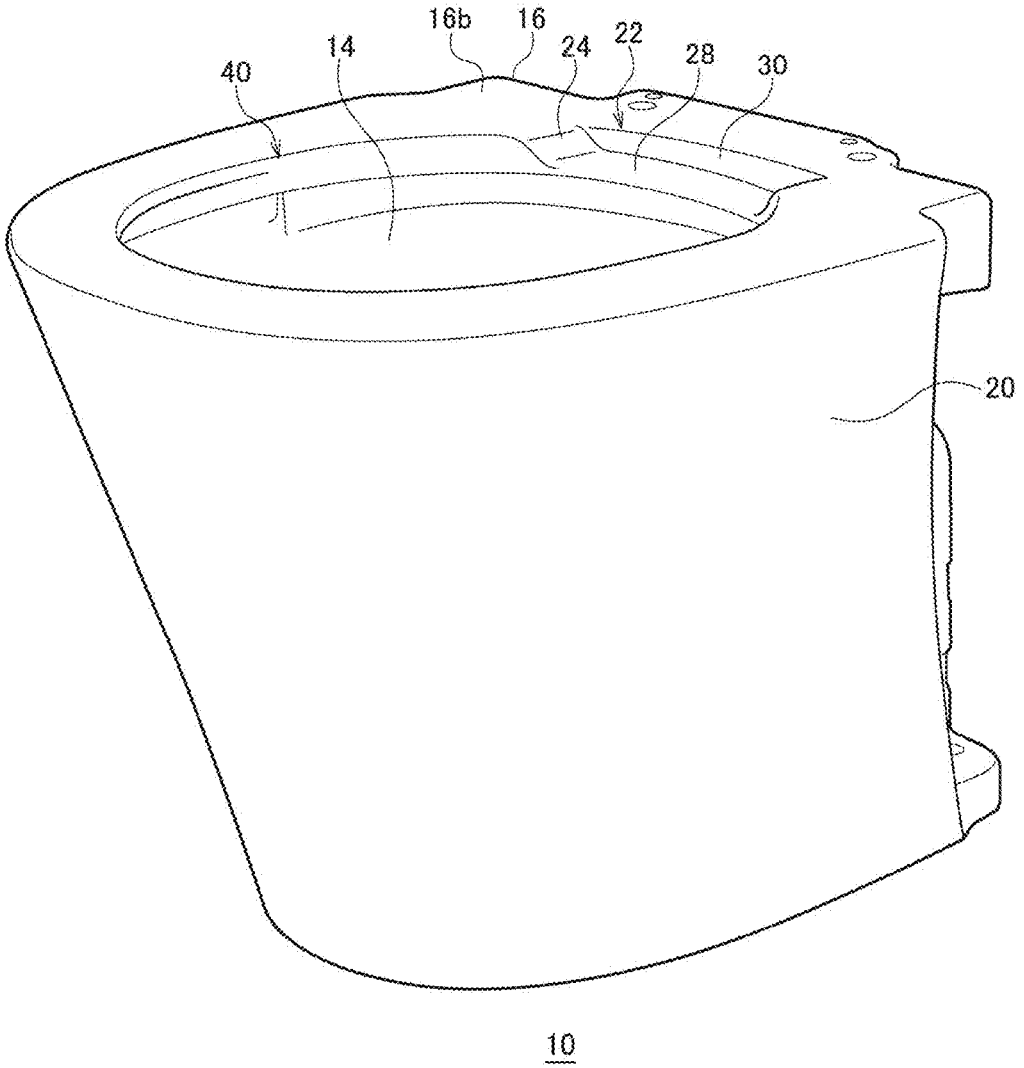
FIG. 3 is a perspective view of a toilet main unit of FIG. 1.
Figure 4:
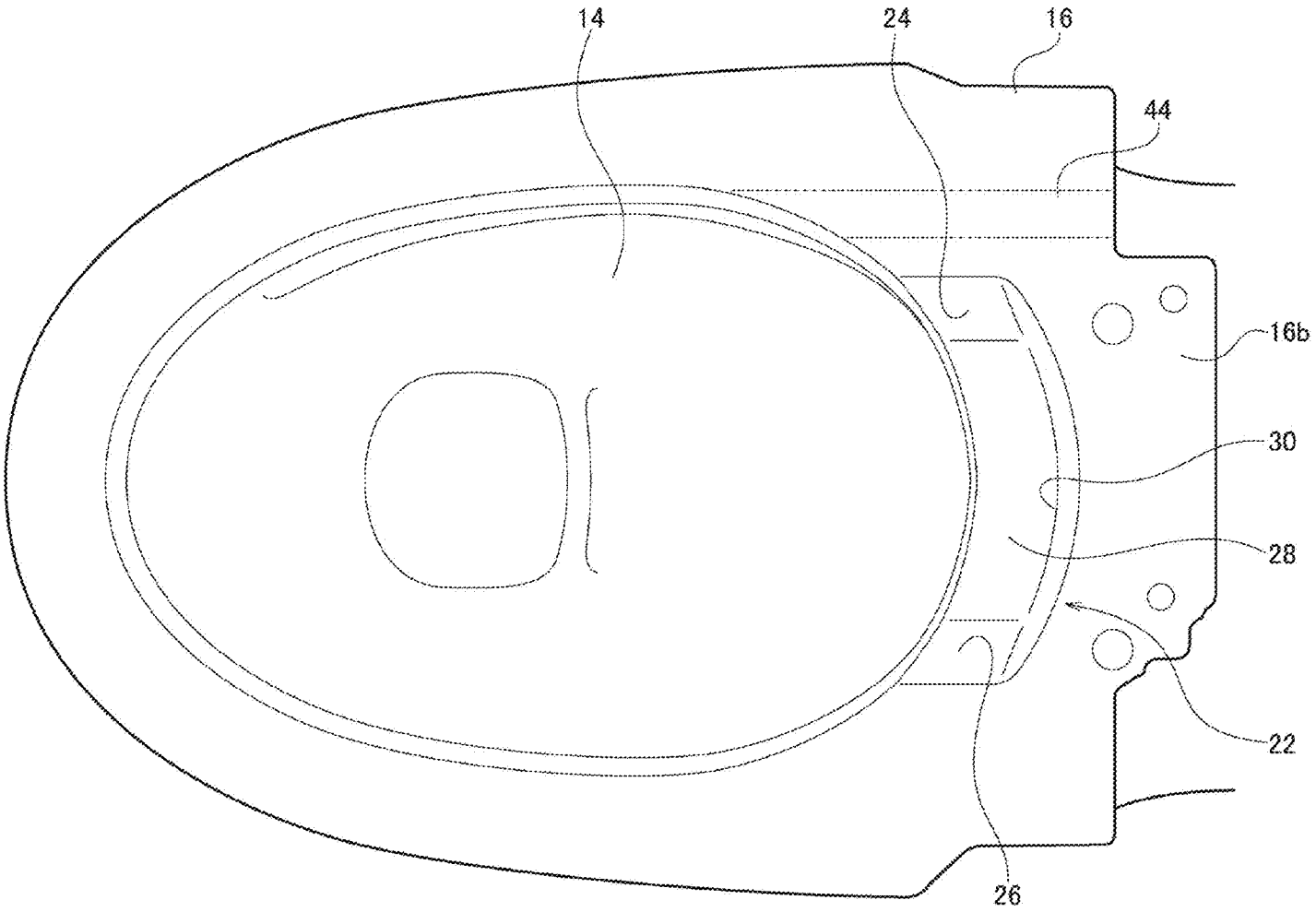
FIG. 4 is a top view of the toilet main unit of FIG. 1.

FIG. 3 is a perspective view of the toilet main unit 10. FIG. 4 is a top view of the toilet main unit 10. On the rear side of the upper surface portion 16, a recessed portion 22, which is recessed in the downward direction, is formed. The recessed portion 22 is particularly formed at a position avoiding a water passage 44 for supplying washing water to the toilet bowl 14 from a water supply source such as a water pipe or the like or a washing water tank (both not shown). Also, the recessed portion 22 is formed at a position avoiding an area over the hollow portion 46. Put another way, the hollow portion 46 is formed at a position avoiding an area under the recessed portion 22. In the present embodiment, the recessed portion 22 is provided above a rear end portion of the toilet bowl 14, and the hollow portion 46 does not exist under the recessed portion 22, in other words, between the recessed portion 22 and the toilet bowl 14. More specifically, the hollow portion 46 does not exist between a flat bottom surface 28 (described later) of the recessed portion 22 and the toilet bowl 14.

The recessed portion 22 is recessed to be lower than the upper surface portion 16 on the front and the side of the toilet bowl 14. The recessed portion 22 is formed to be larger than a projecting portion 12*a*, which is describe later, so as to house the projecting portion 12*a*. The recessed portion 22 extends along the opening portion 40 in the present embodiment. In other words, the recessed portion 22 slightly curves along the opening portion 40 in a planar view. Also, the recessed portion 22 is formed such that the front side of the recessed portion 22 faces the opening portion 40 in the present embodiment. In other words, the recessed portion 22 communicates with the opening portion 40. It can be also considered that the entire front surface in the peripheral surface of the recessed portion 22 is open. Also, the recessed portion 22 has a reverse trapezoidal shape in the front view in the present embodiment.

The recessed portion 22 has a first side surface (right side surface) 24, a second side surface (left side surface) 26, a bottom surface 28, and a back surface 30. The bottom surface 28 is flat and has a shape that is longer in the lateral direction than in the longitudinal direction (i.e., the depth direction). The bottom surface 28 is formed, for example, such that the length in the lateral direction becomes two or more times the length in the depth direction. The bottom surface 28 may be formed, for example, such that the length in the lateral direction becomes longer than the width of the toilet drainage channel 18 in the lateral direction. The bottom surface 28 may be formed, for example, such that the length in the lateral direction becomes longer than half the maximum width of the opening portion 40 in the lateral direction.

The first side surface 24 and the second side surface 26 are provided to be spaced apart from each other in the lateral direction and face the projecting portion 12*a*, which is described later, in the lateral direction. The first side surface 24 and the second side surface 26 are inclined to become closer to be each other toward the lower side, and the respective upper ends thereof are connected to the upper surface of the upper surface portion 16 while the respective lower ends thereof are connected to the bottom surface 28. The first side surface 24 and the second side surface 26 are formed to be flat and relatively gentle inclined surfaces. Preferably, the first side surface 24 and the second side surface 26 are formed to form an angle of 45 degrees or less with the bottom surface 28. In the present embodiment, since the bottom surface 28 is approximately parallel with a horizontal plane, the first side surface 24 and the second side surface 26 are formed to form an angle of 45 degrees or less with the horizontal plane.

The back surface 30 is formed to form an angle of 45 degrees to 90 degrees with the bottom surface 28. In the present embodiment, since the bottom surface 28 is approximately parallel with the horizontal plane as described above, the back surface 30 is formed to form an angle of 45 degrees to 90 degrees with the horizontal plane. In the present embodiment, the back surface 30 is formed to substantially intersect with the bottom surface 28.

The back surface 30 has the shape of a rear end portion of the opening portion 40 that has been offset. More specifically, the back surface 30 is curved to form a convex shape on the rear side. When forming the toilet main unit 10 from a ceramic material, an excess ceramic material is discharged in order to create the hollow portion 46 in the upper surface portion 16 or the like. In the present embodiment, the excess ceramic material is discharged from the front side by lifting the rear side of the toilet main unit 10. Since the back surface 30 is curved to form a convex shape on the rear side as described above, the ceramic material does not remain on the rear side of the back surface 30.

Figure 5A:
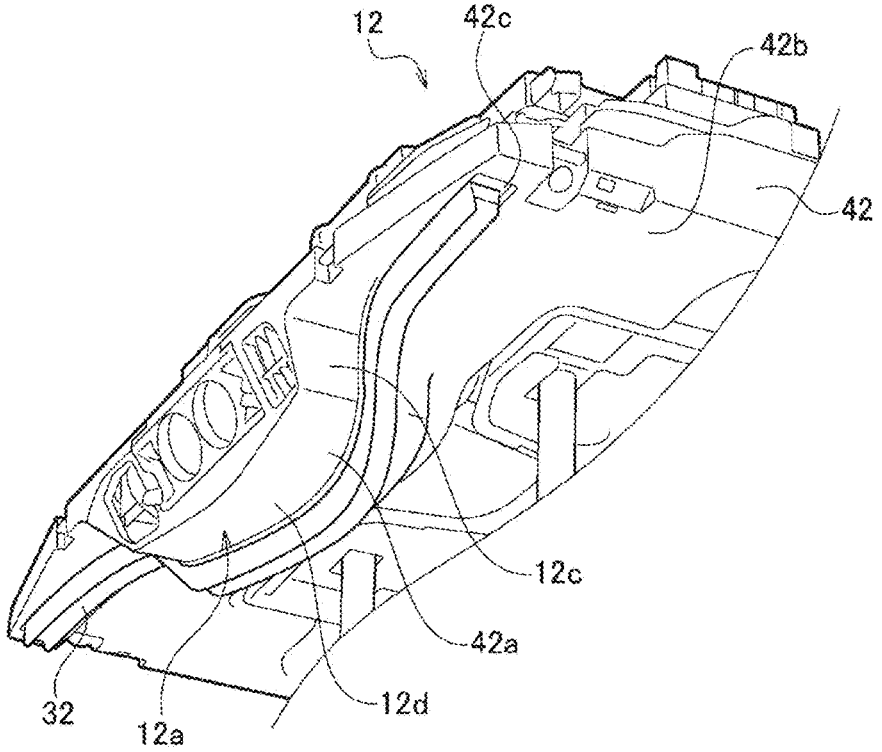
FIGS. 5A and 5B are perspective views of a functional unit of FIG. 1 viewed from the lower front side.
Figure 5B:
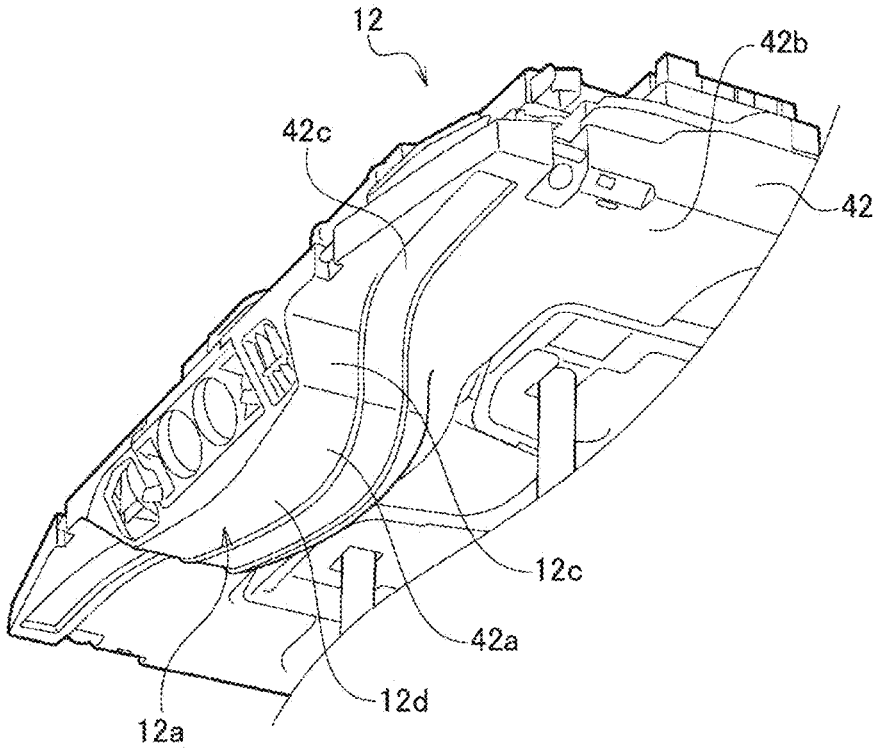

FIGS. 5A and 5B are perspective views of the functional unit 12 viewed from the lower side. The flush toilet 100 is further provided with a long and thin elastic member 32. FIG. 5A shows a state where the elastic member 32 is fixed to the functional unit 12, and FIG. 5B shows a state where the elastic member 32 has been removed. The functional unit 12 further includes a base plate 42. The base plate 42 is placed on the upper surface portion 16 and supports the private part washing device 34, the drying device 36, and the deodorizing device 38.

The functional unit 12 has the projecting portion 12*a*, which projects downward, at the center on the front side of the functional unit 12. This projection unit is constituted with a base recessed portion 42*a* of the base plate 42, which is recessed downward, a tip portion of a nozzle 34*a* of the private part washing device 34 housed in the base recessed portion 42*a*, a warm air outlet 36*a* of the drying device 36, a deodorizing suction opening 38*a* and a deodorizing discharge opening 38*b* of the deodorizing device 38, and a deodorizing cartridge 38*c* located behind these components.

A groove 42*c* is formed roughly in the lateral direction on the lower surface 42*b* of the base plate 42. To the groove 42*c*, the elastic member 32 is fixed detachably by, for example, a double-sided tape. The elastic member 32 is formed of, for example, rubber. The groove 42*c* is formed on the back side of (i.e., behind) the front edge of the functional unit 12. Therefore, the elastic member 32, which is fixed to the groove, is also provided on the back side of the front edge of the functional unit 12. In other words, the elastic member 32 is provided so as not to project to the front side of the front edge of the functional unit 12.

Figure 6A:
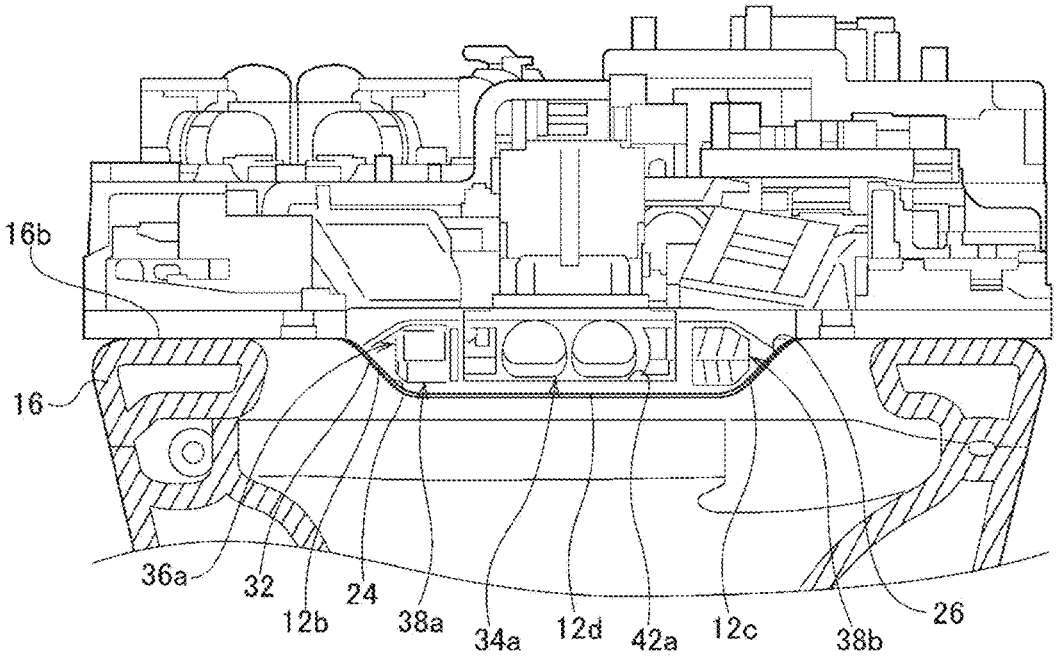
FIGS. 6A and 6B are front views showing a recessed portion and the surroundings thereof.
Figure 6B:
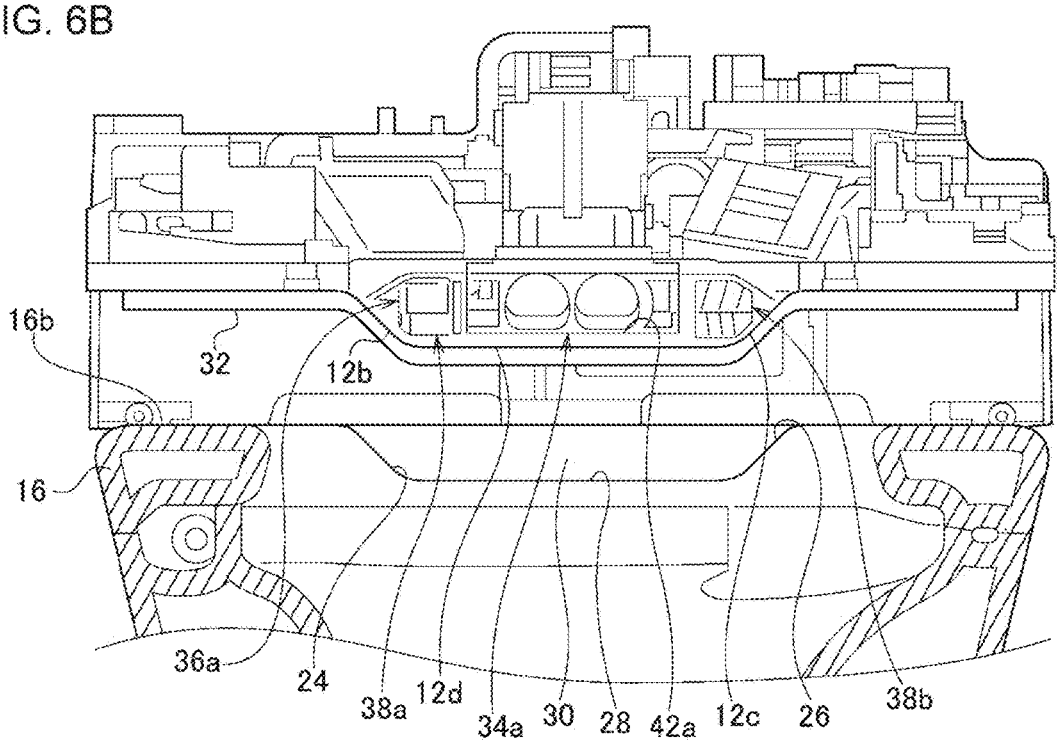
Figure 7A:
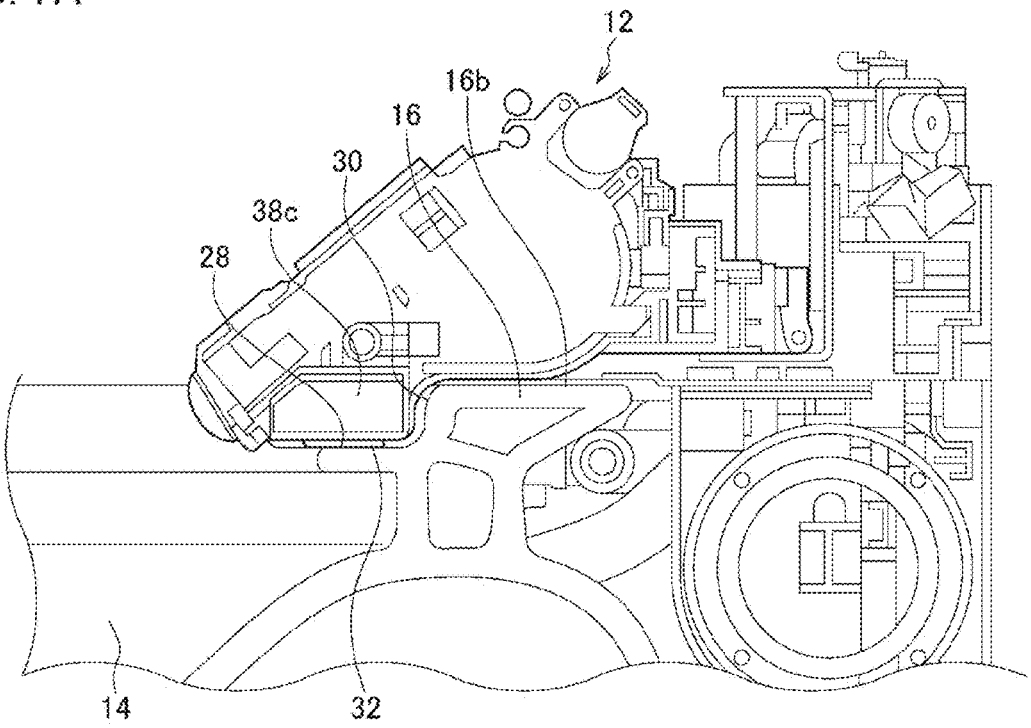
FIGS. 7A and 7B are cross sectional views showing the recessed portion and the surroundings thereof.
Figure 7B:
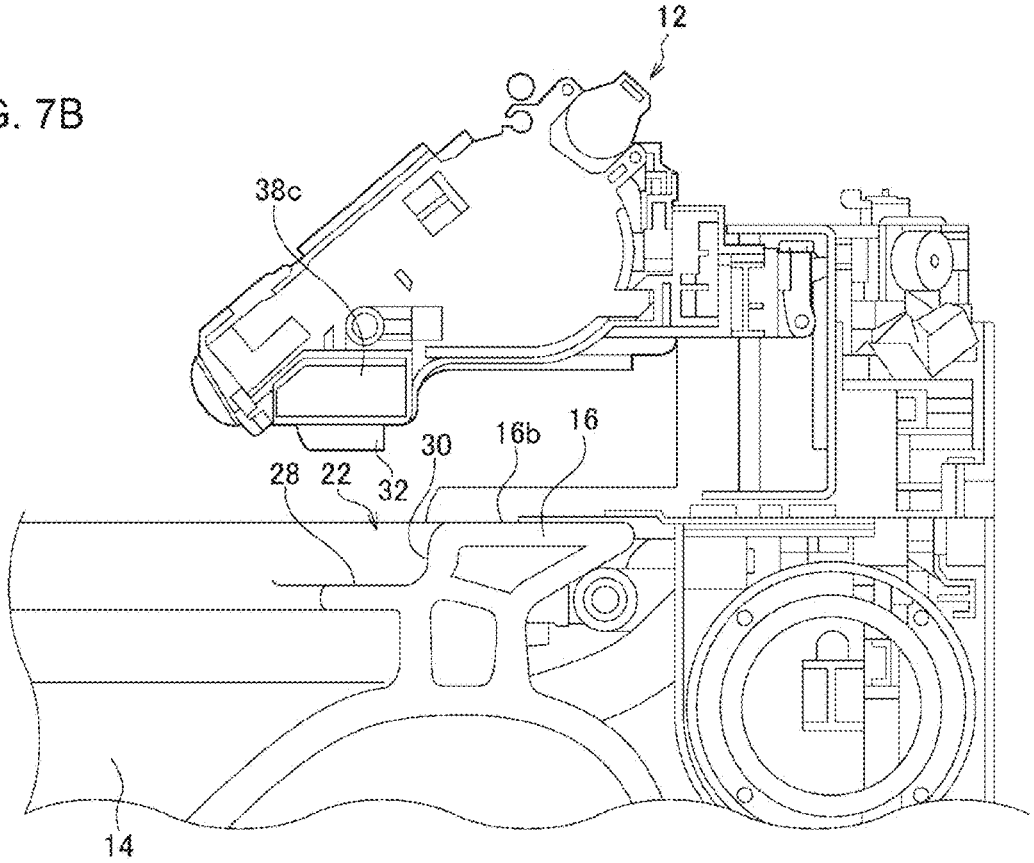

FIGS. 6A and 6B are front views showing the recessed portion 22 and the surroundings thereof. FIGS. 7A and 7B are cross sectional views showing the recessed portion 22 and the surroundings thereof. FIGS. 6A and 7A show a case where the functional unit 12 is at the lowered position, and FIGS. 6B and 7B show a case where the functional unit 12 is at the raised position.

When the functional unit 12 is at the lowered position, the projecting portion 12*a* thereof is located inside the recessed portion 22. More specifically, in the present embodiment, when the functional unit 12 is at the lowered position, the warm air outlet 36*a* of the drying device 36, the deodorizing suction opening 38*a* and the deodorizing discharge opening 38*b* of the deodorizing device 38, and the deodorizing cartridge 38*c* are located inside the recessed portion 22. Therefore, the lowered position can also be considered as an entering position where at least a portion of the functional unit 12 is located inside the recessed portion 22.

On the other hand, when the functional unit 12 is at the raised position, not only the projecting portion 12*a* but also the entire functional unit 12 are located outside the recessed portion 22. In other words, the entirety of the functional unit 12 is not located inside the recessed portion 22. Therefore, the raised position can also be considered as a retreating position where the entire functional unit 12 is located outside the recessed portion 22.

As shown in FIGS. 6A and 7A, when the functional unit 12 is at the lowered position, the elastic member 32 comes into contact with the first side surface 24 of the recessed portion 22 and a first side surface (right side surface) 12*b* of the projecting portion 12*a*, which faces the first side surface 24 in the lateral direction. In the same way, the elastic member 32 comes into contact with the second side surface 26 of the recessed portion 22 and a second side surface (left side surface) 12*c* of the projecting portion 12*a*, which faces the second side surface 26 in the lateral direction.

Further in the present embodiment, the elastic member 32 between the first side surface 24 of the recessed portion 22 and the first side surface 12*b* of the projecting portion 12*a* and the elastic member 32 between the second side surface 26 of the recessed portion 22 and the second side surface 12*c* of the projecting portion 12*a* are continuous with each other passing through a gap between the bottom surface 28 of the recessed portion 22 and the lower surface 12*d* of the projecting portion 12*a*, which face the bottom surface 28 in the vertical direction. The elastic member 32 particularly comes into contact with the bottom surface 28 of the recessed portion 22 and the lower surface 12*d* of the projecting portion 12*a*. In other words, the elastic member 32 is provided so as to fill the gap between the projecting portion 12*a* and the recessed portion 22 in the front view. Further, in the present embodiment, the elastic member 32 extends to a portion of the upper surface portion 16 that is located outside the recessed portion 22 in the lateral direction.

Further, the elastic member 32 is provided on the back side of (i.e., behind) the front edge of the recessed portion 22 (particularly the bottom surface 28) when the functional unit 12 is at the lowered position. In other words, the elastic member 32 is provided so as not to project to the front side of the front edge of the bottom surface 28.

According to the flush toilet 100 according to the present embodiment explained above, the recessed portion 22, which is recessed in the downward direction, is formed on the rear side of the upper surface portion 16. This recessed portion 22 is recessed to be lower than the upper surface portion 16 on the front and the side of the toilet bowl 14 and houses a portion of the functional unit 12. This allows the height of the flush toilet 100 to be reduced. The functional unit 12 can be moved to the retreating position where the entirety thereof is located outside the recessed portion 22, and by moving the functional unit 12 to the retreating position, a space for hand insertion can be created between the functional unit 12 and the upper surface portion 16. The user can insert his/her hand through this space to wipe the rear side of the upper surface portion 16. In other words, according to the flush toilet 100 according to the present embodiment, a flush toilet that is easy to be cleaned while having a relatively reduced height can be achieved.

Further, according to the flush toilet 100 according to the present embodiment, the recessed portion 22 houses a portion of each of the drying device 36 and the deodorizing device 38. The recessed portion 22 particularly houses a portion of each of the drying device 36 and the deodorizing device 38, which are lined up in the lateral direction having the private part washing device 34 in the middle. In other words, the recessed portion 22 is formed to be relatively large in the lateral direction (i.e., the horizontal direction). Therefore, the user can clean the recessed portion 22 by inserting, for example, fingers holding a cleaning tool such as a cloth into the recessed portion 22. In other words, the recessed portion 22 can be cleaned with relative ease. Since a portion of the functional unit 12 is housed in the recessed portion 22, which is formed relatively large, the height of the flush toilet 100 can be reduced. Therefore, according to the flush toilet 100 according to the present embodiment, a flush toilet that is easy to be cleaned while having a relatively reduced height can be achieved.

Further, according to the flush toilet 100 according to the present embodiment, the first side surface 24 and the second side surface 26 are inclined so as to become closer to each other toward the lower side. Preferably, the first side surface 24 and the second side surface 26 are formed to form an angle of 45 degrees or less with the bottom surface 28. Therefore, the user can clean the inside of the recessed portion 22 with relative ease by, for example, sliding a cleaning tool such as a cloth, paper, or a brush inside the recessed portion 22 in the lateral direction. More specifically, the inside of the recessed portion 22 can be easily cleaned by wiping while sliding a cloth or the like, for example, in the order of the first side surface 24, the bottom surface 28, and the second side surface 26 or in the order of the second side surface 26, the bottom surface 28, and the first side surface 24.

Further, according to the flush toilet 100 according to the present embodiment, the recessed portion 22 has the flat bottom surface 28. In general, the recessed portion 22 having the flat bottom surface 28 becomes relatively large in the horizontal direction. Therefore, as described above, the user can clean the recessed portion 22 by inserting, for example, fingers holding a cleaning tool such as a cloth into the recessed portion 22. In other words, the recessed portion 22 can be cleaned with relative ease. Further, as described above, since a portion of the functional unit 12 is housed in the recessed portion 22, which is formed relatively large, the height of the flush toilet 100 can be reduced. Therefore, according to the flush toilet 100 according to the present embodiment, a flush toilet that is easy to be cleaned while having a relatively reduced height can be achieved.

Further, according to the flush toilet 100 according to the present embodiment, the hollow portion 46 does not exist between the recessed portion 22 and the toilet bowl 14. Therefore, since there is not a hollow portion 46, the recessed portion 22 can be formed deeply, and the height of the flush toilet 100 can be reduced even more.

Further, according to the flush toilet 100 according to the present embodiment, a portion of the functional unit 12 is housed in the recessed portion 22 formed on the upper surface portion 16 of the toilet main unit 10, and the portion of the functional unit 12 and the recessed portion 22 come into contact with each other via the elastic member 32. This allows the position of the functional unit 12 in the lateral direction with respect to the toilet main unit 10 to be aligned, and good appearance can thus be ensured for the flush toilet 100. Particularly, even when there are manufacturing errors in the toilet main unit 10 (particularly, the recessed portion 22) and the functional unit 12, the position of the functional unit 12 in the lateral direction with respect to the toilet main unit 10 can be aligned while absorbing the manufacturing errors by the elastic member 32.

Further, according to the flush toilet 100 according to the present embodiment, the first side surface 24 and the second side surface 26 are inclined so as to become closer to each other toward the lower side. When assembling the functional unit 12 onto the flush toilet 100 or when lowering the functional unit 12, which has been raised for cleaning, the functional unit 12 is placed at a desired position with respect to the toilet main unit 10 in a relatively smooth manner while being guided by the first side surface 24 and the second side surface 26.

Further, according to the flush toilet 100 according to the present embodiment, the elastic member 32 extends through a gap where the functional unit 12 and the recessed portion 22 face each other in the vertical direction. In other words, the elastic member 32 is provided so as to fill the gap between the projecting portion 12*a* and the recessed portion 22 in the front view. This allows the elastic member 32 to function as a seal so as to prevent sewage water that has entered the recessed portion 22 from the toilet bowl 14 from passing over the elastic member 32 and flowing in toward the back side. As a result, a portion of the recessed portion 22 that is located on the back side of the elastic member 32, a portion of the upper surface portion 16 that is located behind the recessed portion 22, etc., can be prevented from getting dirty.

Further, according to the flush toilet 100 according to the present embodiment, the first side surface 24 and the second side surface 26 are inclined with respect to the bottom surface 28. If the first side surface 24 or the second side surface 26 stands upright with respect to the bottom surface 28, the elastic member 32 can rise being separated from the recessed portion 22 at a part connecting to the first side surface 24 and the bottom surface 28 and at a part connecting to the second side surface 26 and the bottom surface 28, and a gap can be created between the projecting portion 12*a* and the recessed portion 22 in the front view. Meanwhile, in the flush toilet 100 according to the present embodiment, since the first side surface 24 and the second side surface 26 are inclined with respect to the bottom surface 28 as described above, the elastic member 32 can extend along the recessed portion 22 in such a manner the elastic member 32 does not rise at the connecting parts.

Further, according to the flush toilet 100 according to the present embodiment, the back surface 30 of the recessed portion 22 is formed to form an angle of 45 degrees to 90 degrees with the horizontal plane. Thereby, sewage water that has entered the recessed portion 22 from the toilet bowl 14 can be prevented from passing over the back surface 30 and flowing in toward the back side. As a result, a portion of the upper surface portion 16 that is located behind the recessed portion 22, etc., can be prevented from getting dirty.

Further, according to the flush toilet 100 according to the present embodiment, the elastic member 32 is provided on the back side of the front edge of the functional unit 12. Thereby, it becomes difficult for the elastic member 32 to be visually recognized by the user, and the good appearance of the flush toilet 100 can thus be ensured. Further, according to the flush toilet 100 according to the present embodiment, the elastic member 32 is provided on the back side of the front edge of the bottom surface 28 of the recessed portion 22. This prevents the elastic member 32 from becoming dirty with sewage water, etc., splattered from the toilet bowl 14.

Figure 8:
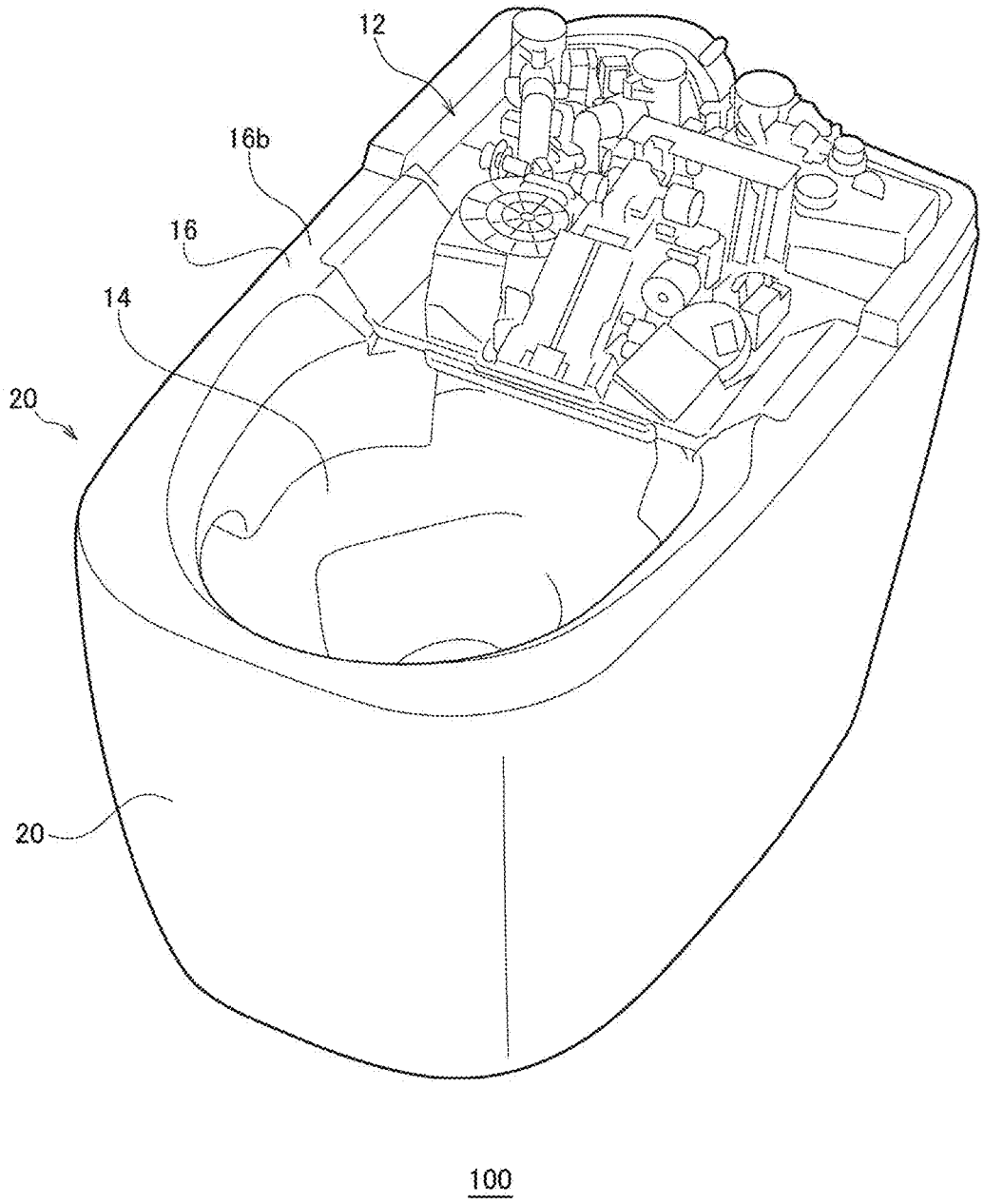
FIG. 8 is a perspective view of a flush toilet according to a second embodiment.

FIG. 8 is a perspective view showing a flush toilet 100 according to a second embodiment. FIG. 8 corresponds to FIG. 1A. The flush toilet 100 is provided with a toilet main unit 10 and a functional unit 12. The toilet main unit 10 includes a toilet bowl 14, an upper surface portion 16, a toilet drainage channel (not shown), and an outer circumferential wall portion 20. In the present embodiment, the flush toilet 100 does not have a cover 13. Instead, the outer circumferential wall portion 20 covers from front to back and from side to side so as to ensure the design of the flush toilet 100.

Figure 9:
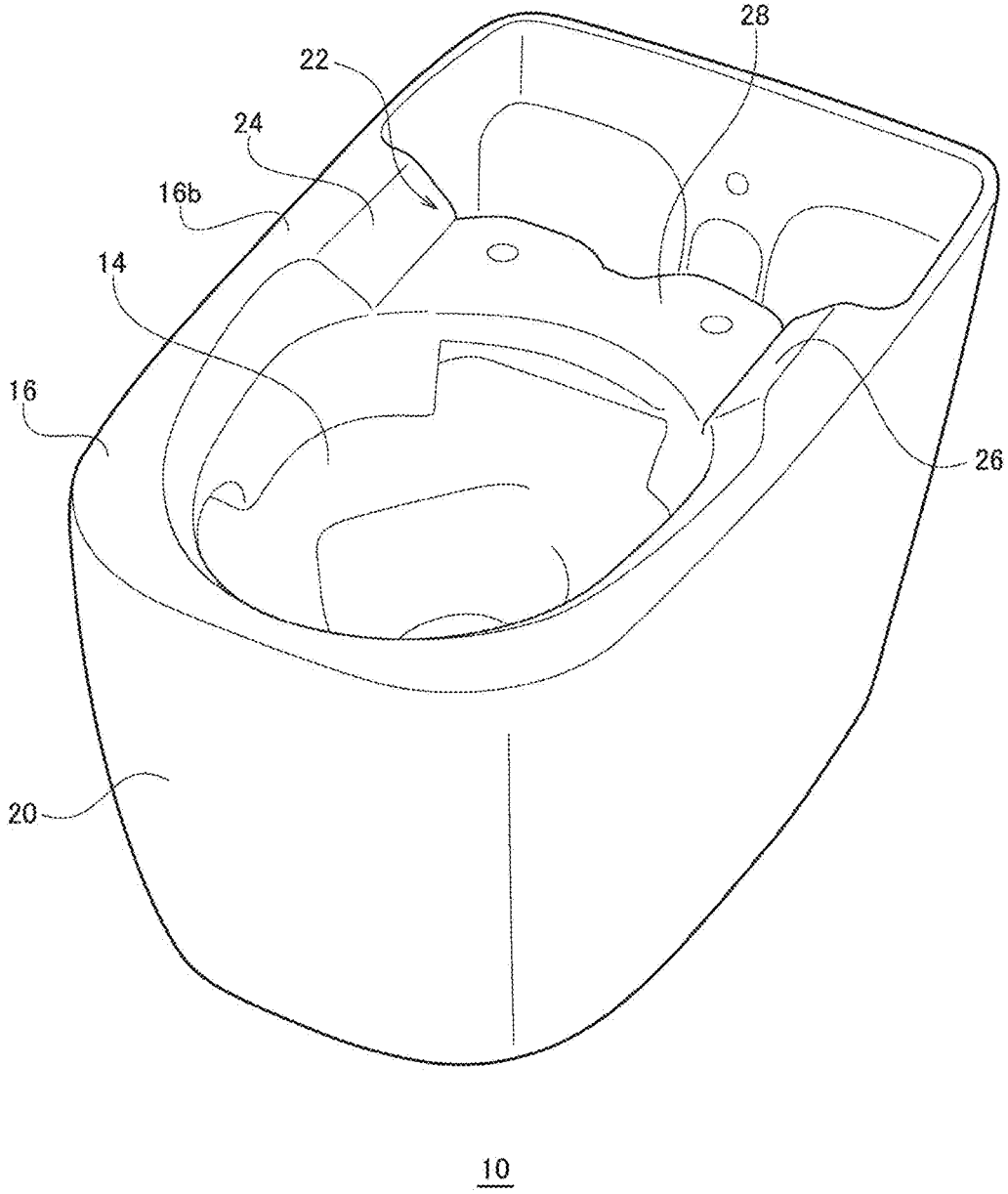
FIG. 9 is a perspective view of a toilet main unit of FIG. 8.

FIG. 9 is a perspective view showing the toilet main unit 10 of FIG. 8. FIG. 9 corresponds to FIG. 3. On the rear side of the upper surface portion 16, a horizontally-long recessed portion 22, which is recessed in the downward direction, is formed. In the present embodiment, the recessed portion 22 is formed in a groove shape that is continuous in a range from the back end edge of the opening portion 40 to the back end edge of the upper surface portion 16. In other words, the recessed portion 22 is formed in a notch shape where the front and the back thereof are open (i.e., does not have the front surface and the back surface). A base plate 42 is housed in the recessed portion 22 such that the entire base plate 42 is located below the upper surface portion 16.

According to the flush toilet 100 according to the present embodiment explained above, operations and effects are achieved that are similar to those achieved by the flush toilet 100 according to the first embodiment. In addition, according to the flush toilet 100 according to the present embodiment, the entire base plate 42 is located below the upper surface portion 16, in other words, the functional unit 12 as a whole is lowered in the downward direction. This allows not only the height of the functional unit with respect to the upper surface portion 16 but also the height of the flush toilet 100 to be reduced.

Above is an explanation for a flush toilet according to the embodiments. These embodiments are intended to be illustrative only, and it will be obvious to those skilled in the art that various modifications to constituting elements could be developed and that such modifications are also within the scope of the present invention.

In the embodiments, an explanation has been given regarding a case where the elastic member 32 between the first side surface 24 of the recessed portion 22 and the first side surface 12*b* of the projecting portion 12*a* and the elastic member 32 between the second side surface 26 of the recessed portion 22 and the second side surface 12*c* of the projecting portion 12*a* are continuous with each other. However, this is non-limiting. An elastic member 32 needs to be provided at least in a gap between the first side surface 24 of the recessed portion 22 and the first side surface 12*b* of the projecting portion 12*a* and in a gap between the second side surface 26 of the recessed portion 22 and the second side surface 12*c* of the projecting portion 12*a*, and the elastic member 32 does not need to be continuous. In other words, an elastic member 32 does not need to exist between the bottom surface 28 of the recessed portion 22 and the lower surface 12*d* of the projecting portion 12*a*.

In the embodiments, an explanation has been given regarding a case where the functional unit 12 includes the private part washing device 34, the drying device 36, and the deodorizing device 38. However, this is non-limiting. The functional unit 12 needs to include at least two devices each offering a function that is different from a function for washing the toilet bowl 14, and at least a portion of each of the two devices needs to be located inside the recessed portion 22 when the functional unit 12 is at the entering position (the lowered position). For example, the functional unit 12 needs to include at least two devices out of a private part washing device 34, a drying device 36, a deodorizing device 38, a toilet seat heating device for warming up a toilet seat, and an indoor heating device for warming up a toilet room, and at least a portion of each of the two devices needs to be located inside the recessed portion 22.

In the embodiments, an explanation has been given regarding a case where the groove 42*c* to which the elastic member 32 is to be fixed is formed on the lower surface 42*b* of the base plate 42 of the functional unit 12. However, this is non-limiting. The position at which the elastic member 32 is to be fixed needs to be known. For example, a sticker showing the position at which the elastic member 32 is to be fixed may be put on the lower surface 42*b* of the base plate 42, or a mark showing the position at which the elastic member 32 is to be fixed may be painted.

Instead of the base plate 42 or in addition to the base plate 42, on the upper surface portion 16, a groove to which the elastic member 32 is to be fixed may be formed, a sticker showing the position for mounting may be put, or a mark showing the position for mounting may be painted. In this case, the elastic member 32 may be fixed to the upper surface portion 16.

The elastic member 32 does not need to be fixed to either of the functional unit and the upper surface portion 16. In this case, the elastic member 32 may be held being sandwiched between the functional unit 12 and the upper surface portion 16.

In the embodiments, an explanation has been given regarding a case where, by the moving up and down of the functional unit 12, the entering position where at least a portion of the functional unit 12 is located inside the recessed portion 22 and the retreating position where the entire functional unit 12 is located outside the recessed portion 22 are moved. However, this is non-limiting. The functional unit 12 only needs to be able to move between the entering position where at least a portion of the functional unit 12 is located inside the recessed portion 22 and the retreating position where the entire functional unit 12 is located outside the recessed portion 22. For example, the rear side of the functional unit 12 may be rotatably supported by a supporting shaft that extends in the lateral direction. In this case, by rotating the functional unit 12 in such a manner that the front side of the functional unit 12 is lifted, the entire functional unit 12 may be moved to the retreating position located outside the recessed portion 22.

In the embodiments, an explanation has been given stating that the length of the bottom surface 28 of the recessed portion 22 in the lateral direction may be longer than the width of the toilet drainage channel 18 in the lateral direction or may be longer than half the maximum width of the opening portion 40 in the lateral direction. However, this is non-limiting. The length of the recessed portion 22 in the lateral direction (i.e., the maximum width of the upper end edge of the recessed portion 22 in the lateral direction) may be longer than the width of the toilet drainage channel 18 in the lateral direction.

Alternatively, the length of the recessed portion 22 in the lateral direction may be longer than half the maximum width of the opening portion 40 in the lateral direction.

Figure 10:
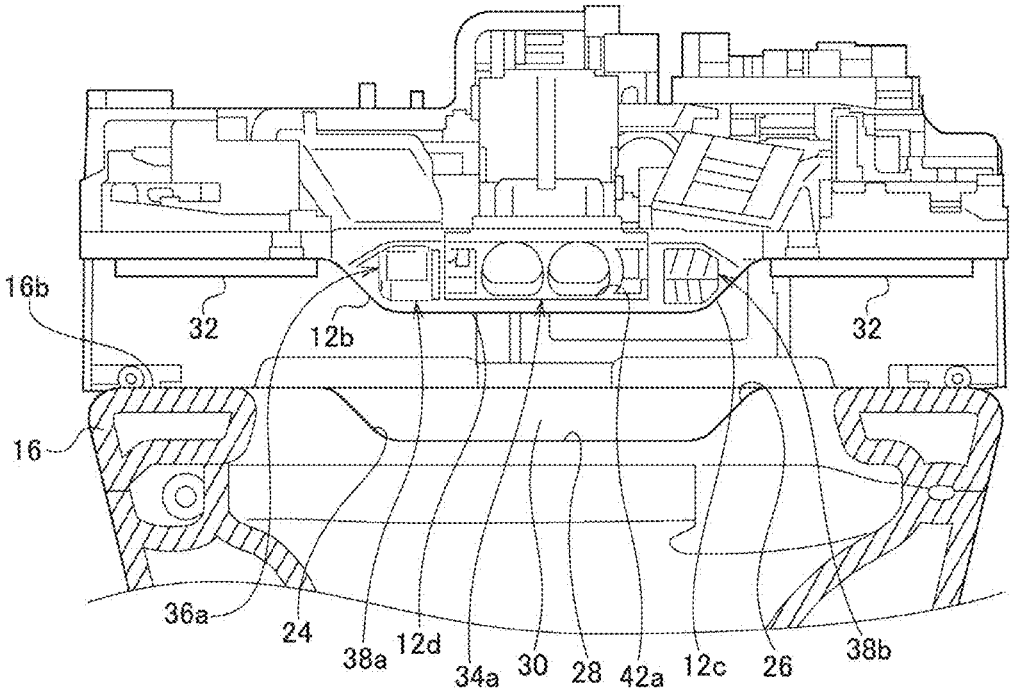
FIG. 10 is a front view showing a recessed portion of a toilet main unit of a flush toilet according to an exemplary variation and the surroundings thereof.

In the embodiments, an explanation has been given regarding a case where the elastic member 32 is provided at the recessed portion 22 and the portion of the upper surface portion 16 that is located outside the recessed portion 22 in the lateral direction. However, this is non-limiting. FIG. 10 is a front view showing a recessed portion 22 of a toilet main unit of a flush toilet according to an exemplary variation and the surroundings thereof. FIG. 10 corresponds to FIG. 6B. In the present exemplary variation, an elastic member 32 is provided only at a part that corresponds to the upper surface portion 16 located outside the recessed portion 22 in the lateral direction. In other words, the elastic member 32 is not provided at a part that corresponds to the recessed portion 22. In this case, sewage water and the like from the toilet bowl 14 are prevented from flowing toward the back side by the back surface 30 in the recessed portion 22, and sewage water and the like from the toilet bowl 14 are prevented from flowing toward the back side by the elastic member 32 at the portion of the upper surface portion 16 located outside the recessed portion in the lateral direction. According to the present exemplary variation, an elastic member 32 does not need to be provided in the recessed portion 22, and the number of elastic members 32 can thus be reduced.

In the embodiments, an explanation has been given regarding a case where the recessed portion 22 has a reverse trapezoidal shape in the front view. However, this is non-limiting. The recessed portion 22 may have a U shape, a V shape, an arc shape, or another shape in the front view. In other words, the first side surface 24 and the second side surface 26 may be formed in a curved shape. Further, the first side surface 24 and the second side surface 26 of the recessed portion 22 may be a portion of a single continuous surface. Alternatively, the first side surface 24 and the second side surface 26 may form a single continuous surface. Also, the recessed portion 22 may have a shape where one or a plurality of recessed portions are formed inside the recessed portion 22. In other words, at least one of the first side surface 24 and the second side surface 26 of the recessed portion 22 may have one or a plurality of step portions.

Described above is an explanation of the present invention based on the several embodiments. These embodiments are intended to be illustrative only, and it will be obvious to those skilled in the art that various modifications and changes can be developed within the scope of the claims of the present invention and that such modifications and changes are also within the scope of the claims of the present invention. Therefore, the descriptions and figures in the specification should be treated demonstratively instead of being treated in a limited manner.

Based on the above descriptions, the following invention is recognized. A flush toilet according to one embodiment of the present invention is provided with: a toilet main unit having a toilet bowl and an upper surface portion on which a recessed portion is formed; and a functional unit that is provided on the rear side of the toilet bowl and offers a function different from a function for washing the toilet bowl. The functional unit is able to move between an entering position where at least a portion of the functional unit is located inside the recessed portion and a retreating position where the entire functional unit is located outside the recessed portion. According to this embodiment, a space for hand insertion can be created between the functional unit and the upper surface portion. A user can insert his/her hand through this space to wipe the rear side of the upper side portion. In other words, according to this embodiment, a flush toilet that is easy to be cleaned while having a relatively reduced height can be achieved.

The functional unit may include a first device and a second device each offering a function that is different from the function for washing the toilet bowl. At least a portion of each of the first device and the second device may be able to move between an entering position where the portion is located inside the recessed portion and a retreating position where the entire devices are located outside the recessed portion. According to this embodiment, the recessed portion is formed to have a size large enough to house at least a portion of each of the first device and the second device. In other words, the recessed portion 22 is formed to be relatively large. Therefore, the user is able to clean the recessed portion 22 with relative ease. Since a portion of the functional unit is housed in the recessed portion 22, which is formed relatively large, the height of the flush toilet can be reduced. In other words, according to this embodiment, a flush toilet that is easy to be cleaned while having a relatively reduced height can be achieved.

The first device and the second device may be lined up in the lateral direction. According to this embodiment, since the recessed portion 22 is formed to be relatively large in the lateral direction (i.e., the horizontal direction), the user is able to clean the recessed portion more easily.

The recessed portion may have a flat bottom surface. In general, the recessed portion having a flat bottom surface becomes large in the horizontal direction. Therefore, according to this embodiment, since the recessed portion is formed to be relatively large in the lateral direction, the user is able to clean the recessed portion 22 more easily.

The bottom surface may be a flat surface whose length in the lateral direction is longer than the length in the depth direction.

The recessed portion may have two side surfaces that are inclined so as to become closer to each other toward the lower side. Each of the two side surfaces may form an angle of 45 degrees or less with the horizontal plane. The two inclined surfaces include a flat inclined surface, a curved inclined surface, and the like. Each of the "two inclined surfaces" may be a portion of a single continuous surface. Alternatively, the "two inclined surfaces" may forma single continuous surface. According to this embodiment, the inside of the recessed portion 22 can be cleaned with relative ease by, for example, sliding a cleaning tool inside the recessed portion 22 in the lateral direction.

The recessed portion may have a back surface that forms an angle of 45 degrees or more with the horizontal plane. According to this embodiment, sewage water and the like that have entered the recessed portion from the toilet bowl can be prevented from passing over the back surface and flowing in toward the back side. As a result, a portion of the upper surface portion that is located behind the recessed portion, etc., can be prevented from getting dirty.

The recessed portion may be a notch shape recessed portion whose front and back are open.

The first device and the second device may be any two devices out of the following: a private part washing device; a drying device; a deodorizing device; a toilet seat heating device; and an indoor heating device.

The upper surface portion may include a hollow portion inside the upper surface portion. The hollow portion does not exist between the recessed portion and the toilet bowl. According to this embodiment, since there is no hollow portion, the recessed portion can be formed deeply, and the height of the flush toilet can be reduced even more.

The invention claimed is:

1. A flush toilet comprising:

a toilet main unit that has a toilet bowl and an upper surface portion on which a recessed portion is formed; and a functional unit that is provided on the rear side of the toilet bowl and offers a function different from a function for washing the toilet bowl, wherein the functional unit is able to move between an entering position where at least a portion of the functional unit is located inside the recessed portion and a retreating position where the entire functional unit is located outside the recessed portion;

wherein the recessed portion has two side surfaces that are inclined so as to become closer to each other toward the lower side, and wherein each of the two side surfaces forms an angle of 45 degrees or less with the horizontal plane.

2. The flush toilet of claim 1, wherein the functional unit includes a first device and a second device each offering a function that is different from the function for washing the toilet bowl, and wherein at least a portion of each of the first device and the second device is able to move between an entering position where the portion is located inside the recessed portion and a retreating position where the entire devices are located outside the recessed portion.

3. The flush toilet of claim 2, wherein the first device and the second device are lined up in the lateral direction.

4. The flush toilet of claim 1, wherein the recessed portion has a flat bottom surface.

5. The flush toilet of claim 4, wherein the bottom surface is a flat surface whose length in the lateral direction is longer than the length in the depth direction.

6. The flush toilet of claim 1, wherein the recessed portion has a back surface that forms an angle of 45 degrees or more with the horizontal plane.

7. The flush toilet of claim 2, wherein the first device and the second device are any two devices out of the following: a private part washing device; a drying device; a deodorizing device; a toilet seat heating device; and an indoor heating device.

8. A flush toilet comprising:

a toilet main unit that has a toilet bowl and an upper surface portion on which a recessed portion is formed; and a functional unit that is provided on the rear side of the toilet bowl and offers a function different from a function for washing the toilet bowl, wherein the functional unit is able to move between an entering position where at least a portion of the functional unit is located inside the recessed portion and a retreating position where the entire functional unit is located outside the recessed portion;

wherein the recessed portion is a notch shape recessed portion whose front and back are open.

9. The flush toilet of claim 8, wherein the functional unit includes a first device and a second device each offering a function that is different from the function for washing the toilet bowl, and wherein at least a portion of each of the first device and the second device is able to move between an entering position where the portion is located inside the recessed portion and a retreating position where the entire devices are located outside the recessed portion.

10. The flush toilet of claim 9, wherein the first device and the second device are lined up in the lateral direction.

11. The flush toilet of claim 8, wherein the recessed portion has a flat bottom surface.

12. The flush toilet of claim 11, wherein the bottom surface is a flat surface whose length in the lateral direction is longer than the length in the depth direction.

13. The flush toilet of claim 8, wherein the recessed portion has a back surface that forms an angle of 45 degrees or more with the horizontal plane.

14. The flush toilet of claim 9, wherein the first device and the second device are any two devices out of the following: a private part washing device; a drying device; a deodorizing device; a toilet seat heating device; and an indoor heating device.

15. A flush toilet comprising:

a toilet main unit that has a toilet bowl and an upper surface portion on which a recessed portion is formed; and a functional unit that is provided on the rear side of the toilet bowl and offers a function different from a function for washing the toilet bowl, wherein the functional unit is able to move between an entering position where at least a portion of the functional unit is located inside the recessed portion and a retreating position where the entire functional unit is located outside the recessed portion;

wherein the upper surface portion includes a hollow portion inside the upper surface portion, and wherein the hollow portion does not exist between the recessed portion and the toilet bowl.

* * * * *